US006698479B1

(12) United States Patent
Kelso

(10) Patent No.: US 6,698,479 B1
(45) Date of Patent: Mar. 2, 2004

(54) LOG CATCHER

(76) Inventor: Warner Kelso, 5 Pawnee Dr., Keokuk, IA (US) 52632

( * ) Notice: Subject to any disclaimer, the term of this patent is extended or adjusted under 35 U.S.C. 154(b) by 0 days.

(21) Appl. No.: 10/304,030

(22) Filed: Nov. 25, 2002

(51) Int. Cl.[7] ..... B27L 7/00

(52) U.S. Cl. ..... 144/366; 108/97; 211/86.01; 269/296; 144/195.1

(58) Field of Search ..... D15/10, 28; 108/12, 108/19, 152, 157, 157.13, 108, 110, 97, 147.1; 211/86.01, 134, 182, 107, 108; 248/923; 269/296, 289 R; 144/193.1, 195.1, 366

(56) References Cited

U.S. PATENT DOCUMENTS

| | | | | | |
|---|---|---|---|---|---|
| 2,713,530 | A | * | 9/1955 | Chisholm | |
| 3,741,131 | A | * | 6/1973 | Leadbetter | 108/97 |
| 4,239,070 | A | | 12/1980 | Burns | 144/193 |
| 4,392,629 | A | * | 7/1983 | Dallman | |
| 4,461,331 | A | | 7/1984 | Mertz | 144/193 |
| 4,487,239 | A | | 12/1984 | Anderson | 144/193 |
| 4,544,008 | A | * | 10/1985 | Reini | 144/195.1 |
| 4,842,030 | A | * | 6/1989 | Meyer | 144/195.1 |
| 5,526,855 | A | * | 6/1996 | Graham | 144/195.1 |
| D457,174 | S | * | 5/2002 | Bissell | D15/28 |

* cited by examiner

*Primary Examiner*—W. Donald Bray
(74) *Attorney, Agent, or Firm*—Goldstein Law Offices, P.C.

(57) ABSTRACT

A log catcher for catching and holding logs which fall from a log splitter which is supported upon an I-beam. The log catcher comprises five parallel cylindrical rods each having two ends, a horizontal first cross-beam attached to the rods at one end, and a horizontal second cross-beam attached to the rods at the other end. The log catcher further comprises an angular cross-beam having evenly spaced holes through which the rods extend at a point which is substantially closer to the second cross-beam than to the first cross-beam. All five rods are evenly spaced throughout. Each rod has a right angle bend, thereby forming a curved portion, wherein the falling logs may be effectively contained. In use, the log catcher is positioned below the I-beam, and the second cross-beam and the angular cross-beam effectively bracket the lower surface of the I-beam, thereby imparting additional stability to the log catcher.

7 Claims, 3 Drawing Sheets

LOG CATCHER

BACKGROUND OF THE INVENTION

1. Field of the Invention

The invention relates to a log catcher for use in receiving and holding logs which have been cut by a log splitter.

2. Description of the Related Art

A variety of devices are available for splitting logs. U.S. Pat. No. 4,487,239 to Anderson appears to show a log splitter with an automatic hoist for lifting logs onto the platform of the splitter. U.S. Pat. No. 4,239,070 to Burns appears to show a log splitter in which two splitting edges are employed. However, noticeably absent from these devices is a log catcher for receiving and holding the split logs when they have fallen from the log splitter. Accordingly, there is a need for a device which may be appended to an existing log splitter for catching the split logs as they fall from the log splitter.

U.S. Pat. No. 4,461,331 to Mertz appears to show a log splitter with a log catcher incorporated to receive the split logs. However, the log catcher in Mertz is an integral part of the log splitting device. Accordingly, Mertz fails to provide a log catcher which may be used with an existing log splitter.

While these units may be suitable for the particular purpose employed, or for general use, they would not be as suitable for the purposes of the present invention as disclosed hereafter.

SUMMARY OF THE INVENTION

It is an object of the invention to produce a log catcher which may be readily used with existing log splitters supported upon I-beams. Accordingly, the log catcher is ready for use after a portion of the log catcher is placed underneath and brackets the I-beam.

It is another object of the invention to produce a log catcher which is rugged enough to withstand repeated impacts from falling logs. Accordingly, the log catcher is constructed of metal and will not be damaged by logs as they fall onto the log catcher.

It is yet another object of the invention to produce a log catcher which is not overly complicated. Accordingly, the log catcher is simply constructed from five rods which are joined at various positions along their length by three horizontal beams.

It is still yet another object of the invention to produce a log catcher which is not unduly expensive. Accordingly, the log catcher is constructed from inexpensive materials, so that its cost is not prohibitive.

It is still another object of the invention to produce a log catcher which remains immobile, even when impacted by falling logs. Accordingly, the log catcher is stabilized by the weight of the I-beam and the log splitter, and it will not move when it is impacted by falling logs.

It is an additional object of the invention to produce a log catcher which is easy to use. Accordingly, the log catcher requires no maintenance, and a user simply removes the fallen logs from the log catcher when they have accumulated.

The invention is a log catcher for catching and holding logs which fall from a log splitter which is supported upon an I-beam. The log catcher comprises five parallel cylindrical rods each having two ends, a horizontal first cross-beam attached to the rods at one end, and a horizontal second cross-beam attached to the rods at the other end. The log catcher further comprises an angular cross-beam having evenly spaced holes through which the rods extend at a point which is substantially closer to the second cross-beam than to the first cross-beam. All five rods are evenly spaced throughout. Each rod has a right angle bend, thereby forming a curved portion, wherein the falling logs may be effectively contained. In use, the log catcher is positioned below the I-beam, and the second cross-beam and the angular cross-beam effectively bracket the lower surface of the I-beam, thereby imparting additional stability to the log catcher.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
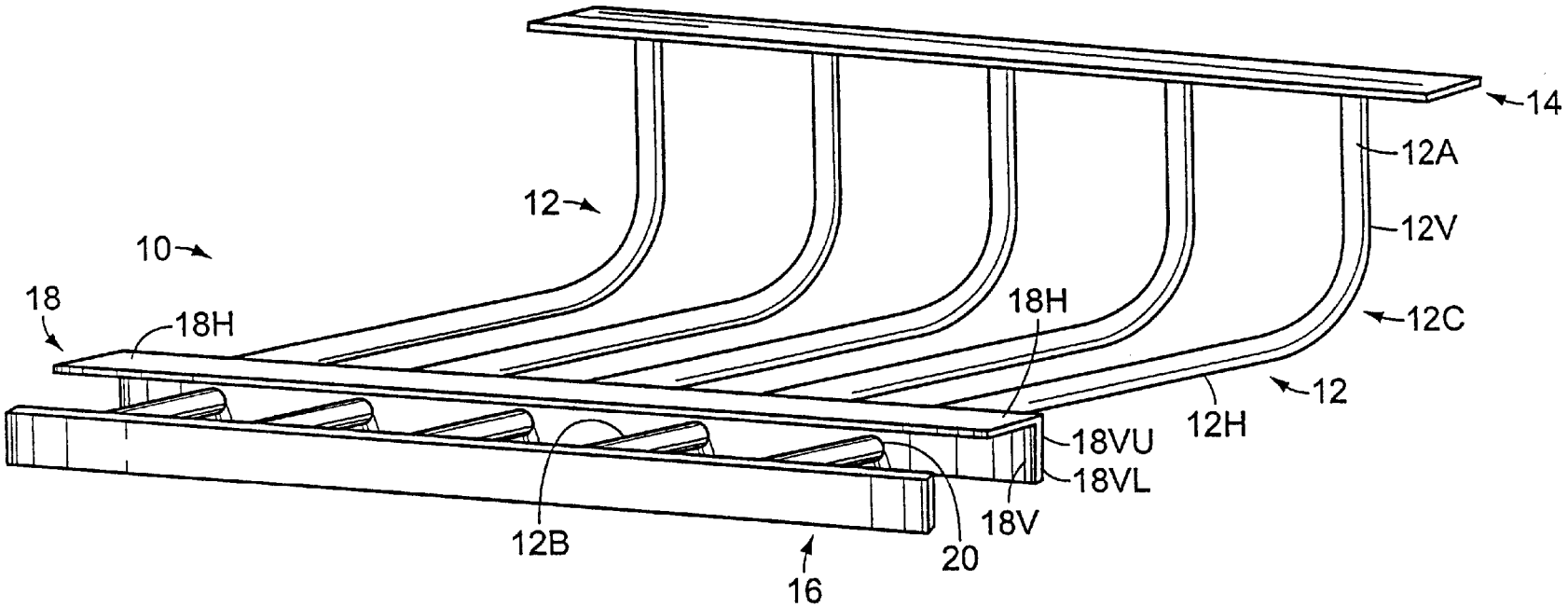
FIG. 1 is a perspective view of the log catcher.

FIG. 1 illustrates a perspective view of the log catcher 10 comprising five cylindrical rods 12 each having a first end 12A and a second end 12B, a horizontal first cross-beam 14 attached to the rods at their first end 12A, and a horizontal second cross-beam 16 attached to the rods 12 at their second end 12B. The log catcher 10 further comprises an angular cross-beam 18 having five evenly spaced holes 20 with an inner diameter sized to accommodate the outer diameter of the rods 12. Each rod 12 extends through one of the holes 20 of the angular cross-beam 18 at a point which is substantially closer to their second end 12B than to their first end 12A. All five rods 12 are parallel to each other along their entire lengths and are evenly spaced along the horizontal first cross-beam 14, the second cross-beam 16, and the angular cross-beam 18.

Each rod 12 is bent at substantially a right angle at a position which is closer to the first end 12A then to the second end 12B, thereby forming a hopper 12C. Each rod 12 has a horizontal portion 12H and a vertical portion 12V, wherein the horizontal portion 12H is attached to first cross-beam 14 at the first end 12A of the rod 12 and the vertical portion 12V is attached to the second cross beam 16 at the second end 12B of the rod 12.

Figure 2A:
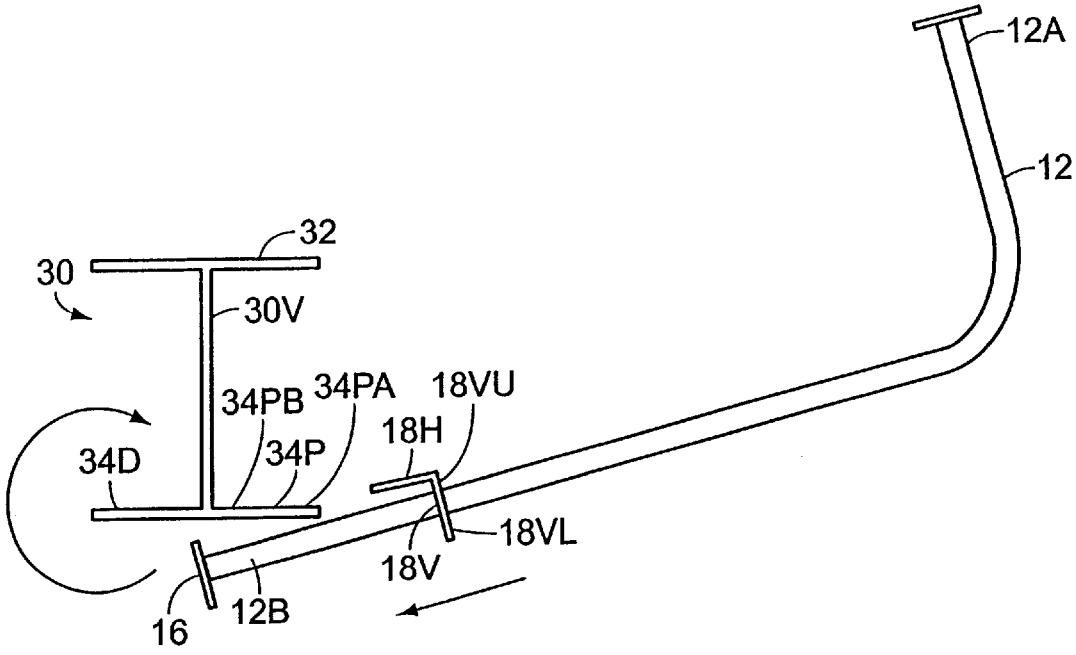
FIG. 2A is a side view of the log catcher being positioned below an I-beam.

FIG. 2A illustrates a side view of the log catcher 10 being positioned below an I-beam 30. An I-beam 30 is an I-shaped structure used to support log-splitting machinery of various kinds. The I-beam 30 has a horizontal upper surface 32, a horizontal lower surface 34, and a vertical portion 30V which extends between the upper surface 32 and the lower surface 34. Various types of log splitting equipment may be placed upon the horizontal upper surface 32. The horizontal lower surface 34 is the foundation of the I-beam 30 and may be positioned on the upper surface of the ground upon which the I-beam 30 rests. The lower surface 34 of the I-beam 30 is separated by the vertical portion 30V into an outer flange 34D and an inner flange 34P. When the log catcher 10 is installed onto the I-beam 30, the inner flange 34P is closer to the hopper 12C than the outer flange 34D.

FIG. 2A illustrates that the angular cross-beam 18 has a horizontal portion 18H and a vertical portion 18V. The vertical portion 18V of the angular cross-beam has an upper portion 18VU and a lower portion 18VL. The horizontal portion 18H extends at a right angle from the upper portion 18VU partially towards the second end 12B of the rods 12.

Turning momentarily to FIG. 1, each of the five rods 12 extend through a hole 20 extending through the vertical portion 18V of the angular cross-beam 18 at a position on the vertical portion 18V which is substantially midway between the upper vertical portion 18VU and the lower vertical portion 18VL.

FIG. 2A indicates how the log catcher 10 is positioned under the I-beam 30. The second cross-beam 16 is extended underneath the lower surface 34 of the I-beam 30 toward the outer flange 34D until the edge 34PA of the inner flange 34P substantially abuts the upper portion 18VU of the angular cross-beam 18. This causes the lower surface 34 to be effectively bracketed between the second cross-beam 16 and the horizontal portion 18H and vertical portion 18V of the angular cross-beam 18. The log catcher 10 is further stabilized by the weight of the I-beam 30 and the log splitting equipment which rests on the horizontal upper surface 32 of the I-beam 30.

Figure 2B:
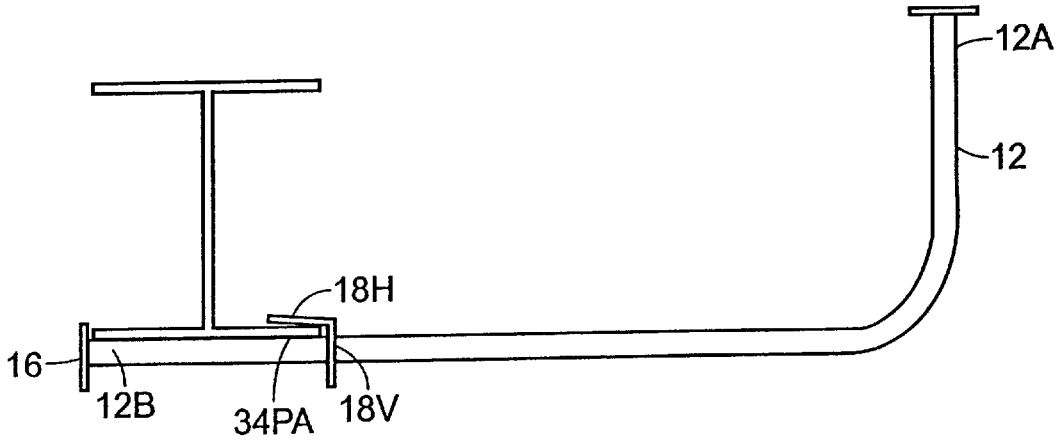
FIG. 2B is a side view of the log catcher after it has been positioned below an I-beam.

FIG. 2B illustrates a side view of the log catcher 10 after it has been positioned below an I-beam 30 of a log splitter. The lower surface 34 of the I-beam 30 rests directly on the log catcher 10 at a position substantially between the second cross-beam 16 and the angular cross-beam 18. The horizontal portion 18H of the angular cross-beam 18 overlays the edge 34PA of the lower surface 34.

Figure 3:
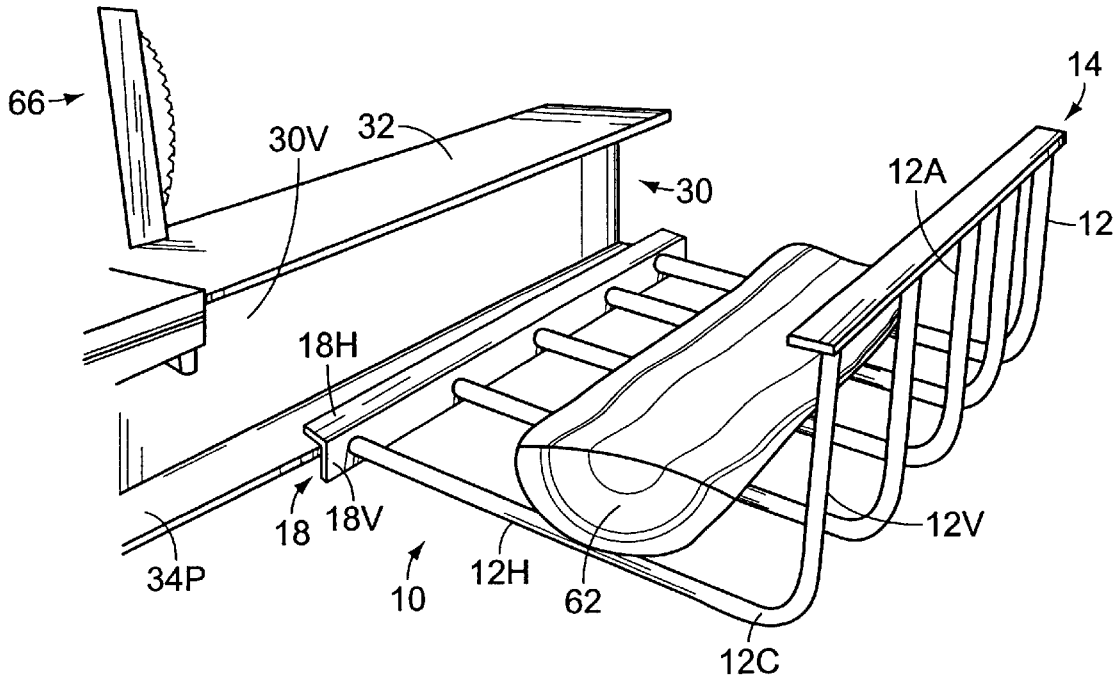
FIG. 3 is a perspective view of the log catcher being deployed to catch logs after they have been cut by a log splitter.

FIG. 3 illustrates a perspective view of the log catcher 10 after it has been positioned below an I-beam 30 which is supporting a log splitter 66. A log 62 is being held by the log catcher 10 between the I-beam 30 and the vertical portion 12V of the rods 12. Turning momentarily to FIG. 2B, the weight of the log 62 further stabilizes the log catcher 10 by causing the log catcher 10 to pivot at the point of contact of the angular cross-beam 18 with the I-beam 30.

In use, a user positions the log catcher 10 underneath an I-beam 30 which has a log splitter 66 positioned on its upper surface 32 by extending the second cross-beam 16 underneath the lower surface 34 of the I-beam as described above. The weight of the I-beam 30 and the overlying log splitter 66 rests on the horizontal portion 12H of the rods 12, thereby imparting the log catcher 10 with additional stability. The user then activates the log splitter 66 which splits the logs into smaller portions. The smaller logs fall away from the log-splitter 66 and onto the horizontal portion 12H of the rods 12. After a number of logs have fallen on top of the log catcher 10 between the vertical portion 12V of the rods 12 and the vertical portion 30V of the I-beam 30, the logs may be removed from the log catcher 10. Additional logs may then be split.

What is claimed is:

1. A log catcher, for use in receiving and holding logs which have been cut by a log splitter resting upon an I-beam, comprising:

at least two rods each having a first end and a second end, the rods are bent upward near the first end to form a hopper for receiving split logs;

a horizontal first cross-beam attached to the rods at their first end;

a horizontal second cross-beam attached to the rods at their second end; and a third cross-beam located at a point between the first end of the rods and the second end of the rods, having holes through which the rods extend, whereby the lower surface of the I-beam may be placed upon the rods between the second cross-beam and the third cross-beam and effectively bracketed between the second cross-beam and the third cross-beam.

2. The log catcher as recited in claim 1, wherein each rod extends through one of the holes of the third cross-beam at a point which is substantially closer to the second end of the rod then to the first end of the rod.

3. The log catcher as recited in claim 2, wherein the rods are parallel to each other along their entire lengths and are evenly spaced along the first cross-beam, the second cross-beam, and the third cross-beam.

4. The log catcher as recited in claim 3, wherein the third cross beam is an angular cross-beam, having a vertical portion and a horizontal portion extending at a right angle from the vertical portion partially toward the second cross-beam, wherein the holes extending through the third cross-beam extend through the vertical portion of the angular cross-beam.

5. The log catcher as recited in claim 4, wherein the log catcher comprises five rods.

6. The log catcher as recited in claim 5, wherein the rods are cylindrical.

7. A method of using a log catcher, by a user, for receiving and holding logs which have been cut by a log splitter resting upon an I-beam, said log catcher having five rods each having a first end and a second end, a horizontal first cross-beam attached to the rods at their first end, a horizontal second cross-beam attached to the rods at their second end, and an angular cross-beam having five evenly spaced holes through which the rods extend at a point which is substantially closer to their second end than to their first end, whereby the lower surface of the I-beam may be effectively bracketed between the second cross-beam and the angular cross-beam, comprising the steps of:

a) raising the lower surface of the I-beam;

b) positioning the log catcher beneath the lower surface of the I-beam by extending the second cross-beam underneath the lower surface of the I-beam until the lower surface is effectively bracketed between the second cross-beam and the angular cross-beam;

c) splitting a log with the log splitter;

d) catching the split log within the log catcher; and e) repeating the steps (c) through (e) until a sufficient quantity of logs have been split.

* * * * *